US009353699B2

(12) United States Patent
Pursifull et al.

(10) Patent No.: US 9,353,699 B2
(45) Date of Patent: May 31, 2016

(54) RAPID ZERO FLOW LUBRICATION METHODS FOR A HIGH PRESSURE PUMP

(71) Applicant: Ford Global Technologies, LLC, Dearborn, MI (US)

(72) Inventors: Ross Dykstra Pursifull, Dearborn, MI (US); Gopichandra Surnilla, West Bloomfield, MI (US); Hao Zhang, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 274 days.

(21) Appl. No.: 14/231,451

(22) Filed: Mar. 31, 2014

(65) Prior Publication Data

US 2015/0275816 A1 Oct. 1, 2015

(51) Int. Cl.

*F02D 41/38* (2006.01)
*F02D 41/30* (2006.01)
*F02D 41/08* (2006.01)

(Continued)

(52) U.S. Cl.

CPC ..... *F02D 41/3845* (2013.01); *F02D 41/08* (2013.01); *F02D 41/123* (2013.01); *F02D 41/3094* (2013.01); *F02D 2041/141* (2013.01); *F02D 2200/0602* (2013.01); *F02D 2200/0604* (2013.01); *F02M 59/367* (2013.01); *F02M 59/462* (2013.01); *F02M 59/464* (2013.01); *F02M 63/0001* (2013.01); *F02M 63/029* (2013.01)

(58) Field of Classification Search

CPC ..... F02D 41/08; F02D 41/15; F02D 41/123; F02D 41/3082; F02D 41/38454; F02D 2250/31; F02D 2200/0602; F02M 2025/0845; F02M 37/0029; F02M 59/366–59/368

USPC ..... 123/456, 457, 458, 490, 495, 497; 73/114.41, 114.43; 701/104, 112

See application file for complete search history.

(56) References Cited

U.S. PATENT DOCUMENTS 5,771,864 A * 6/1998 Morishita ..... F02D 41/3827 123/456
6,209,525 B1 4/2001 Konishi et al.

(Continued)

FOREIGN PATENT DOCUMENTS

EP 2647824 A1 9/2013

OTHER PUBLICATIONS

Surnilla, Gopichandra et al., "Adaptive Learning of Duty Cycle for a High Pressure Fuel Pump," U.S. Appl. No. 14/099,615, filed Dec. 6, 2013, 44 pages.

(Continued)

*Primary Examiner* — Lindsay Low
*Assistant Examiner* — Robert Werner
(74) *Attorney, Agent, or Firm* — Julia Voutyras; Alleman Hall McCoy Russell & Tuttle LLP

(57) ABSTRACT

Methods are provided for rapid zero flow lubrication of a high pressure fuel pump, wherein a fuel rail pressure rapidly responds to commanded duty cycles. A method is needed to control operation of the high pressure pump during times when no direct injection is requested by an engine system and when operation of the high pressure pump is continued to maintain pump lubrication. To lubricate the high pressure pump while gaining zero flow rate data, methods are proposed that involve both open and closed loop control of the high pressure pump.

20 Claims, 8 Drawing Sheets

(51) Int. Cl.

| | |
|---|---|
| ***F02D 41/12*** | (2006.01) |
| *F02D 41/14* | (2006.01) |
| *F02M 63/00* | (2006.01) |
| *F02M 63/02* | (2006.01) |
| *F02M 59/36* | (2006.01) |
| *F02M 59/46* | (2006.01) |

(56) References Cited

U.S. PATENT DOCUMENTS

| | | | | |
|---|---|---|---|---|
| 6,871,633 | B1 | 3/2005 | Date et al. | |
| 6,953,025 | B2 | 10/2005 | Takahashi | |
| 7,013,872 | B2 * | 3/2006 | Yamazaki | F02D 41/3836 123/431 |
| 7,258,103 | B2 | 8/2007 | Tahara et al. | |
| 7,950,371 | B2 | 5/2011 | Cinpinski et al. | |
| 8,342,151 | B2 | 1/2013 | Gwidt et al. | |
| 2009/0090331 | A1 | 4/2009 | Pursifull | |
| 2011/0097228 | A1 | 4/2011 | Tokuo et al. | |
| 2012/0143475 | A1 | 6/2012 | Ryoo et al. | |
| 2012/0167859 | A1 * | 7/2012 | Basmaji | F02D 19/0605 123/456 |
| 2013/0213359 | A1 | 8/2013 | Zeng et al. | |

OTHER PUBLICATIONS

Zhang, Hao et al., "Methods for Correcting Spill Valve Timing Error of a High Pressure Pump," U.S. Appl. No. 14/189,926, filed Feb. 25, 2014, 51 pages.

Pursifull, Ross D. et al., "Direct Injection Fuel Pump," U.S. Appl. No. 14/198,082, filed Mar. 5, 2014, 67 pages.

Ulrey, Joseph N. et al., "Adjusting Pump Volume Commands for Direct Injection Fuel Pumps," U.S. Appl. No. 14/300,162, filed Jun. 9, 2014, 42 pages.

* cited by examiner

RAPID ZERO FLOW LUBRICATION METHODS FOR A HIGH PRESSURE PUMP

FIELD

The present application relates generally to implementation of methods for increasing the response time of fuel rail pressure to an increase in duty cycle of a high pressure fuel pump in an internal combustion engine.

SUMMARY/BACKGROUND

Some vehicle engine systems utilize both direct in-cylinder fuel injection and port fuel injection. The fuel delivery system may include multiple fuel pumps for providing fuel pressure to the fuel injectors. As one example, a fuel delivery system may include a lower pressure fuel pump (or lift pump) and a higher pressure (or direct injection) fuel pump arranged between the fuel tank and fuel injectors. The high pressure fuel pump may be coupled to the direct injection system upstream of a fuel rail to raise a pressure of the fuel delivered to the engine cylinders through the direct injectors. A solenoid activated inlet check valve, or spill valve, may be coupled upstream of the high pressure pump to regulate fuel flow into the pump compression chamber. However, when the high pressure fuel pump is turned off, such as when no direct injection of fuel is requested, pump durability may be affected. Specifically, the lubrication and cooling of the pump may be reduced while the solenoid activated inlet check valve of the high pressure pump is not energized, thereby leading to pump degradation. Therefore, it may be beneficial to operate the high pressure pump even while direct injection is not requested in order to maintain sufficient lubrication. During this operating condition, the high pressure pump may be adjusted to maintain a peak compression chamber pressure while not sending fuel into the direct injection fuel rail. This type of operation may be referred to as zero flow lubrication.

In one approach to implement zero flow lubrication of the high pressure pump, shown by Basmaji et al. in US 2012/0167859, closed loop (or feedback) control is used to increment duty cycle of the high pressure pump while operation of the high pressure pump is not required (zero flow lubrication). In this method, first a mass of fuel may be ingested into the pump that maintains a pressure at the pump outlet that is at or just below an estimate fuel rail pressure. Next, during closed loop control, the stroke amount of the pump may be increased intermittently. If fuel rail pressure does not increase, then the stroke amount may be further increased until a change (increase) in fuel rail pressure is detected. Alternatively, if fuel rail pressure does respond to the increased stroke, then pump operation may be decreased to a lower stroke amount such that fuel rail pressure does not respond to pump operation. As such, the approach of Basmaji et al. may attempt to compensate for variability between engines by learning high pressure pump operation during zero flow lubrication methods onboard the vehicle.

However, the inventors herein have identified potential issues with the approach of US 2012/0167859. First, while the method of Basmaji et al. may provide pump lubrication, the method may be unable to generate a full range of data that corresponds to a zero flow rate from the high pressure pump into the fuel rail. The method of Basmaji et al. provides data below or near the fuel rail pressure, but once fuel rail pressure increases pump duty cycle immediately decreases such that data may only be accrued around a near-constant, desired fuel rail pressure. Furthermore, the inventors herein have recognized that while incrementing pump duty cycle, the time before a substantially steady-state (or stable) fuel rail pressure is reached may be 10 seconds or longer. The time period to wait may be too long if a large amount of zero flow data is desired in a short amount of time.

Thus in one example, the above issues may be at least partially addressed by a method that enables faster performing of zero flow lubrication. In one example, the method comprises: while not direct injecting fuel into an engine and while the engine is in a stabilized idling condition; estimating a target fuel rail pressure based on a commanded duty cycle of a high pressure fuel pump; performing a closed loop control scheme until fuel rail pressure reaches a percentage of the target pressure; and performing an open loop control scheme until fuel rail pressure reaches the target fuel rail pressure. In this way, both open and closed loop controls may be used to accelerate the response time of the fuel rail pressure each time pump duty cycle is incrementally increased.

Furthermore, this method, also referred to herein as the rapid zero flow lubrication test, may repeatedly perform a routine that first commands closed loop control of the high pressure pump until a certain fuel rail pressure is reached, then commands open loop control until the steady-state fuel rail pressure is reached. This method may take a shorter amount of time than other methods, thereby enhancing its utility to gain a large amount of zero flow data in less time. Finally, as zero flow rate data may be plotted in order to estimate various properties such as fuel temperature, fuel composition, and fuel density, then those properties may be estimated at a faster rate than other methods.

It is noted that pump duty cycle refers to controlling the closing of the pump solenoid activated inlet check valve (spill valve), where the spill valve controls the amount of fuel pumped into a fuel rail. For example, if the spill valve closes coincident with the beginning of the engine compression stroke, the event is referred to as a 100% duty cycle. If the spill valve closes 95% into the compression stroke, the event is referred to as a 5% duty cycle. When a 5% duty cycle is commanded, in effect 95% of the displaced fuel volume is spilled and the remaining 5% is compressed during the compression stroke of the pump piston. Duty cycle is equivalent to spill valve timing, in particular the closing of the spill valve. Duty cycle is also equivalent to trapping volume fraction, or the amount of fuel that remains in the compression chamber of the high pressure pump during its compression stroke.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following detailed description provides information regarding a high pressure fuel pump, its related fuel and engine systems, and the proposed rapid zero flow lubrication test and associated routine as well as slower tests for comparison. An example embodiment of a cylinder in an internal combustion engine is given in FIG. 1 while FIG. 2 depicts a fuel system that may be used with the engine of FIG. 1. An example of a high pressure pump configured to provide direct fuel injection into the engine is showed in detail in FIG. 3. A slow routine is shown in FIG. 4 that increments high pressure pump duty cycle and waits for a responsive fuel rail pressure as commanded by an open loop control. Repeated use of the slow routine can be incorporated in a slow zero flow lubrication test, as displayed in FIG. 5. A proposed rapid routine is shown in FIG. 6 that increments high pressure pump duty cycle based on both closed and open loop control. Repeated use of the rapid routine can be incorporated in a rapid zero flow lubrication test, as displayed in FIG. 7. Finally, a rapid zero flow lubrication routine is depicted as a flow chart in FIG. 8, showing each step of the process for attaining zero flow data.

Regarding terminology used throughout this detailed description, several graphs are presented wherein data points are plotted on 2-dimensional graphs. The terms graph and plot are used interchangeably to refer to the entire graph or the curve/line itself. Furthermore, a high pressure pump, or direct injection pump, may be abbreviated as a DI or HP pump. Similarly, a low pressure pump, or lift pump, may be abbreviated as a LP pump. Also, fuel rail pressure, or the value of pressure of fuel within fuel rail of the direct injectors, may be abbreviated as FRP. Zero flow lubrication (ZFL) may refer to high pressure pump operation schemes that involve pumping substantially no fuel into a fuel rail (which may include the direct injection fuel rail) while maintaining fuel rail pressure near a constant value or incrementally increasing fuel rail pressure. ZFL may be used to attain zero flow rate data, as further described below. As described in the summary above, pump duty cycle is used in reference to the high pressure pump and is also referred to as the closing of the spill valve, or valve timing. Also, the spill valve is equivalent to the solenoid activated inlet check valve.

Figure 1:
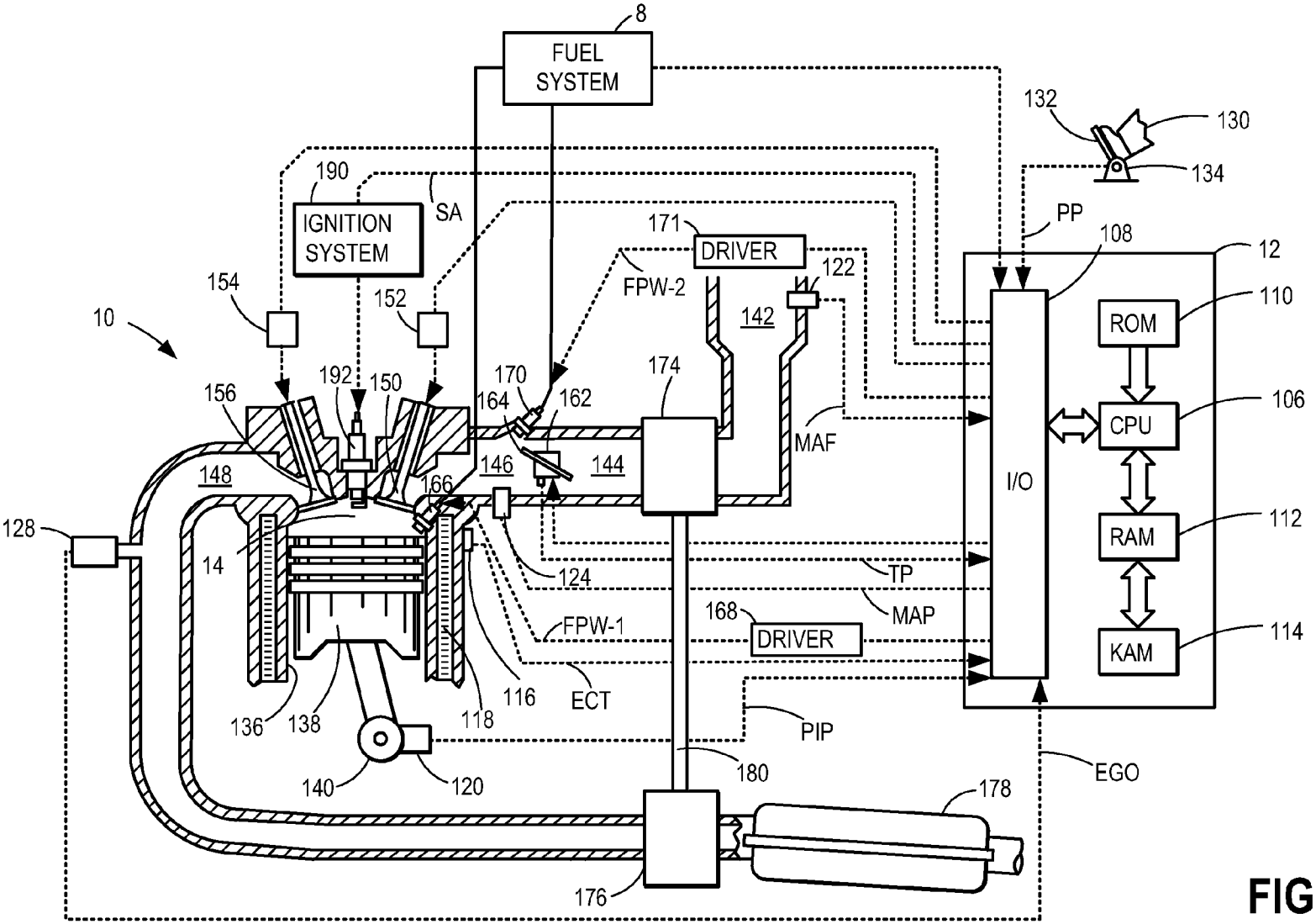
FIG. 1 schematically depicts an example embodiment of a cylinder of an internal combustion engine.
Figure 2:
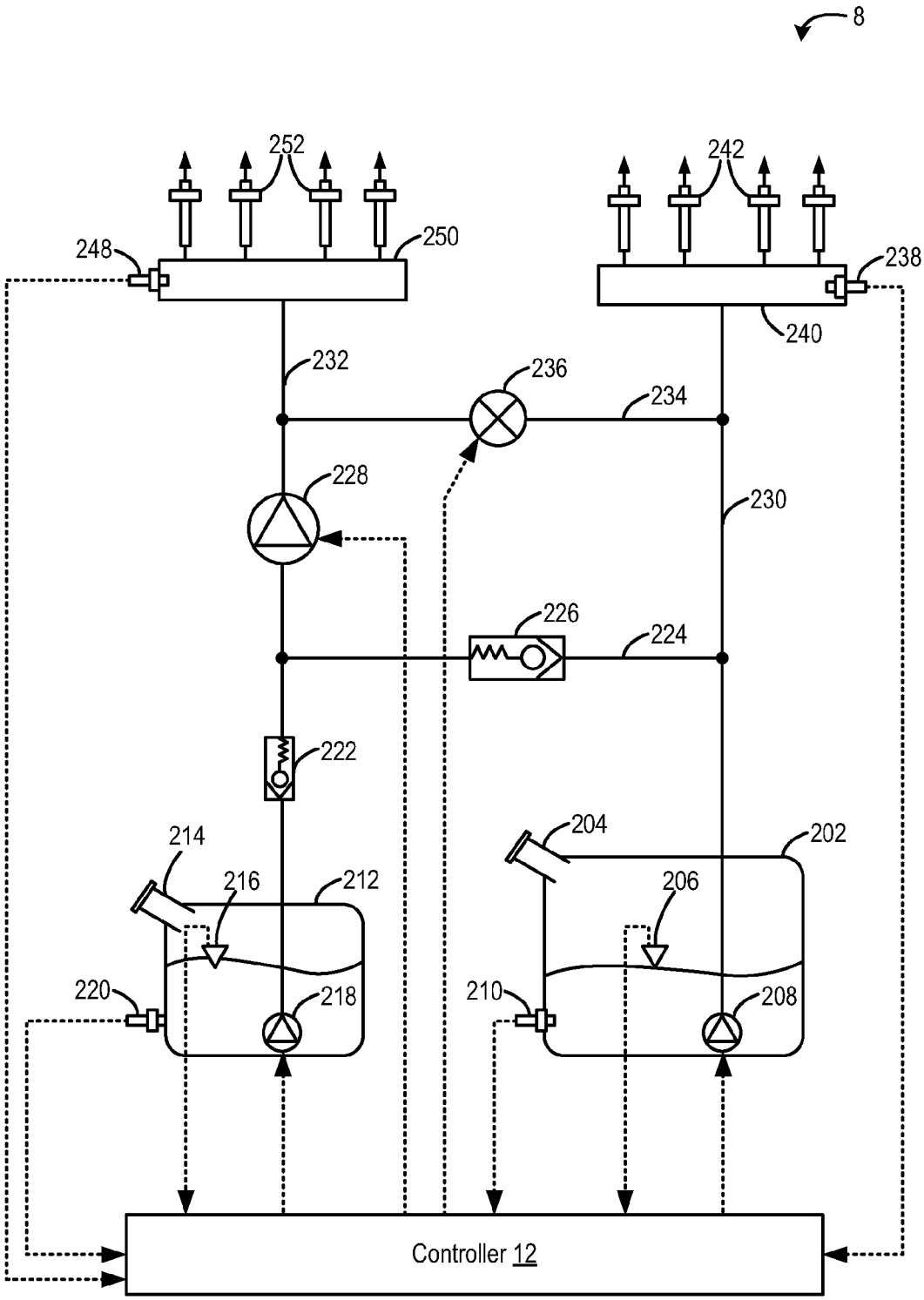
FIG. 2 schematically depicts an example embodiment of a fuel system that may be used with the engine of FIG. 1.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber') 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center.

In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIGS. 2 and 3, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

FIG. 2 schematically depicts an example fuel system 8 of FIG. 1. Fuel system 8 may be operated to deliver fuel to an engine, such as engine 10 of FIG. 1. Fuel system 8 may be operated by a controller to perform some or all of the operations described with reference to the process flows of FIG. 6.

Fuel system 8 can provide fuel to an engine from one or more different fuel sources. As a non-limiting example, a first fuel tank 202 and a second fuel tank 212 may be provided. While fuel tanks 202 and 212 are described in the context of discrete vessels for storing fuel, it should be appreciated that these fuel tanks may instead be configured as a single fuel tank having separate fuel storage regions that are separated by a wall or other suitable membrane. Further still, in some embodiments, this membrane may be configured to selectively transfer select components of a fuel between the two or more fuel storage regions, thereby enabling a fuel mixture to be at least partially separated by the membrane into a first fuel type at the first fuel storage region and a second fuel type at the second fuel storage region.

In some examples, first fuel tank 202 may store fuel of a first fuel type while second fuel tank 212 may store fuel of a second fuel type, wherein the first and second fuel types are of differing composition. As a non-limiting example, the second fuel type contained in second fuel tank 212 may include a higher concentration of one or more components that provide the second fuel type with a greater relative knock suppressant capability than the first fuel.

By way of example, the first fuel and the second fuel may each include one or more hydrocarbon components, but the second fuel may also include a higher concentration of an alcohol component than the first fuel. Under some conditions, this alcohol component can provide knock suppression to the engine when delivered in a suitable amount relative to the first fuel, and may include any suitable alcohol such as ethanol, methanol, etc. Since alcohol can provide greater knock suppression than some hydrocarbon based fuels, such as gasoline and diesel, due to the increased latent heat of vaporization and charge cooling capacity of the alcohol, a fuel containing a higher concentration of an alcohol component can be selectively used to provide increased resistance to engine knock during select operating conditions.

As another example, the alcohol (e.g. methanol, ethanol) may have water added to it. As such, water reduces the alcohol fuel's flammability giving an increased flexibility in storing the fuel. Additionally, the water content's heat of vaporization enhances the ability of the alcohol fuel to act as a knock suppressant. Water may also act as a diluent for temperature control of the combustion chamber, such as combustion chamber 14 of FIG. 1. Further still, the water content can reduce the fuel's overall cost.

As a specific non-limiting example, the first fuel type in the first fuel tank may include gasoline and the second fuel type in the second fuel tank may include ethanol. As another non-limiting example, the first fuel type may include gasoline and the second fuel type may include a mixture of gasoline and ethanol. In still other examples, the first fuel type and the second fuel type may each include gasoline and ethanol, whereby the second fuel type includes a higher concentration of the ethanol component than the first fuel (e.g., E10 as the first fuel type and E85 as the second fuel type). As yet another example, the second fuel type may have a relatively higher octane rating than the first fuel type, thereby making the second fuel a more effective knock suppressant than the first fuel. It should be appreciated that these examples should be considered non-limiting as other suitable fuels may be used that have relatively different knock suppression characteristics. In still other examples, each of the first and second fuel tanks may store the same fuel. While the depicted example illustrates two fuel tanks with two different fuel types, it will be appreciated that in alternate embodiments, only a single fuel tank with a single type of fuel may be present.

Fuel tanks 202 and 212 may differ in their fuel storage capacities. In the depicted example, where second fuel tank 212 stores a fuel with a higher knock suppressant capability, second fuel tank 212 may have a smaller fuel storage capacity than first fuel tank 202. However, it should be appreciated that in alternate embodiments, fuel tanks 202 and 212 may have the same fuel storage capacity.

Fuel may be provided to fuel tanks 202 and 212 via respective fuel filling passages 204 and 214. In one example, where the fuel tanks store different fuel types, fuel filling passages 204 and 214 may include fuel identification markings for identifying the type of fuel that is to be provided to the corresponding fuel tank.

A first low pressure fuel pump (LPP) 208 in communication with first fuel tank 202 may be operated to supply the first type of fuel from the first fuel tank 202 to a first group of port injectors 242, via a first fuel passage 230. In one example, first fuel pump 208 may be an electrically-powered lower pressure fuel pump disposed at least partially within first fuel tank 202. Fuel lifted by first fuel pump 208 may be supplied at a lower pressure into a first fuel rail 240 coupled to one or more fuel injectors of first group of port injectors 242 (herein also referred to as first injector group). While first fuel rail 240 is shown dispensing fuel to four fuel injectors of first injector group 242, it will be appreciated that first fuel rail 240 may dispense fuel to any suitable number of fuel injectors. As one example, first fuel rail 240 may dispense fuel to one fuel injector of first injector group 242 for each cylinder of the engine. Note that in other examples, first fuel passage 230 may provide fuel to the fuel injectors of first injector group 242 via two or more fuel rails. For example, where the engine cylinders are configured in a V-type configuration, two fuel rails may be used to distribute fuel from the first fuel passage to each of the fuel injectors of the first injector group.

Direct injection fuel pump 228 that is included in second fuel passage 232 and may be supplied fuel via LPP 208 or LPP 218. In one example, direct injection fuel pump 228 may be an engine-driven, positive-displacement pump. Direct injection fuel pump 228 may be in communication with a group of direct injectors 252 via a second fuel rail 250, and the group of port injectors 242 via a solenoid valve 236. Thus, lower pressure fuel lifted by first fuel pump 208 may be further pressurized by direct injection fuel pump 228 so as to supply higher pressure fuel for direct injection to second fuel rail 250 coupled to one or more direct fuel injectors 252 (herein also referred to as second injector group). In some examples, a fuel filter (not shown) may be disposed upstream of direct injection fuel pump 228 to remove particulates from the fuel. Further, in some examples a fuel pressure accumulator (not shown) may be coupled downstream of the fuel filter, between the low pressure pump and the high pressure pump.

A second low pressure fuel pump 218 in communication with second fuel tank 212 may be operated to supply the second type of fuel from the second fuel tank 202 to the direct injectors 252, via the second fuel passage 232. In this way, second fuel passage 232 fluidly couples each of the first fuel tank and the second fuel tank to the group of direct injectors. In one example, second fuel pump 218 may also be an electrically-powered low pressure fuel pump (LPP), disposed at least partially within second fuel tank 212. Thus, lower pressure fuel lifted by low pressure fuel pump 218 may be further pressurized by higher pressure fuel pump 228 so as to supply higher pressure fuel for direct injection to second fuel rail 250 coupled to one or more direct fuel injectors. In one example, second low pressure fuel pump 218 and direct injection fuel pump 228 can be operated to provide the second fuel type at a higher fuel pressure to second fuel rail 250 than the fuel pressure of the first fuel type that is provided to first fuel rail 240 by first low pressure fuel pump 208.

Fluid communication between first fuel passage 230 and second fuel passage 232 may be achieved through first and second bypass passages 224 and 234. Specifically, first bypass passage 224 may couple first fuel passage 230 to second fuel passage 232 upstream of direct injection fuel pump 228, while second bypass passage 234 may couple first fuel passage 230 to second fuel passage 232 downstream of direct injection fuel pump 228. One or more pressure relief valves may be included in the fuel passages and/or bypass passages to resist or inhibit fuel flow back into the fuel storage tanks. For example, a first pressure relief valve 226 may be provided in first bypass passage 224 to reduce or prevent back flow of fuel from second fuel passage 232 to first fuel passage 230 and first fuel tank 202. A second pressure relief valve 222 may be provided in second fuel passage 232 to reduce or prevent back flow of fuel from the first or second fuel passages into second fuel tank 212. In one example, lower pressure pumps 208 and 218 may have pressure relief valves integrated into the pumps. The integrated pressure relief valves may limit the pressure in the respective lift pump fuel lines. For example, a pressure relief valve integrated in first fuel pump 208 may limit the pressure that would otherwise be generated in first fuel rail 240 if solenoid valve 236 were (intentionally or unintentionally) open and while direct injection fuel pump 228 were pumping.

In some examples, the first and/or second bypass passages may also be used to transfer fuel between fuel tanks 202 and 212. Fuel transfer may be facilitated by the inclusion of additional check valves, pressure relief valves, solenoid valves, and/or pumps in the first or second bypass passage, for example, solenoid valve 236. In still other examples, one of the fuel storage tanks may be arranged at a higher elevation than the other fuel storage tank, whereby fuel may be transferred from the higher fuel storage tank to the lower fuel storage tank via one or more of the bypass passages. In this way, fuel may be transferred between fuel storage tanks by gravity without necessarily requiring a fuel pump to facilitate the fuel transfer.

The various components of fuel system 8 communicate with an engine control system, such as controller 12. For example, controller 12 may receive an indication of operating conditions from various sensors associated with fuel system 8 in addition to the sensors previously described with reference to FIG. 1. The various inputs may include, for example, an indication of an amount of fuel stored in each of fuel storage tanks 202 and 212 via fuel level sensors 206 and 216, respectively. Controller 12 may also receive an indication of fuel composition from one or more fuel composition sensors, in addition to, or as an alternative to, an indication of a fuel composition that is inferred from an exhaust gas sensor (such as sensor 128 of FIG. 1). For example, an indication of fuel composition of fuel stored in fuel storage tanks 202 and 212 may be provided by fuel composition sensors 210 and 220, respectively. Additionally or alternatively, one or more fuel composition sensors may be provided at any suitable location along the fuel passages between the fuel storage tanks and their respective fuel injector groups. For example, fuel composition sensor 238 may be provided at first fuel rail 240 or along first fuel passage 230, and/or fuel composition sensor 248 may be provided at second fuel rail 250 or along second fuel passage 232. As a non-limiting example, the fuel composition sensors can provide controller 12 with an indication of a concentration of a knock suppressing component contained in the fuel or an indication of an octane rating of the fuel. For example, one or more of the fuel composition sensors may provide an indication of an alcohol content of the fuel.

Note that the relative location of the fuel composition sensors within the fuel delivery system can provide different advantages. For example, sensors 238 and 248, arranged at the fuel rails or along the fuel passages coupling the fuel injectors with one or more fuel storage tanks, can provide an indication of a resulting fuel composition where two or more different fuels are combined before being delivered to the engine. In contrast, sensors 210 and 220 may provide an indication of the fuel composition at the fuel storage tanks, which may differ from the composition of the fuel actually delivered to the engine.

Controller 12 can also control the operation of each of fuel pumps 208, 218, and 228 to adjust an amount, pressure, flow rate, etc., of a fuel delivered to the engine. As one example, controller 12 can vary a pressure setting, a pump stroke amount, a pump duty cycle command and/or fuel flow rate of the fuel pumps to deliver fuel to different locations of the fuel system. A driver (not shown) electronically coupled to controller 12 may be used to send a control signal to each of the low pressure pumps, as required, to adjust the output (e.g. speed) of the respective low pressure pump. The amount of first or second fuel type that is delivered to the group of direct injectors via the direct injection pump may be adjusted by adjusting and coordinating the output of the first or second LPP and the direct injection pump. For example, the lower pressure fuel pump and the higher pressure fuel pump may be operated to maintain a prescribed fuel rail pressure. A fuel rail pressure sensor coupled to the second fuel rail may be configured to provide an estimate of the fuel pressure available at the group of direct injectors. Then, based on a difference between the estimated rail pressure and a desired rail pressure, the pump outputs may be adjusted. In one example, where the high pressure fuel pump is a volumetric displacement fuel pump, the controller may adjust a flow control valve of the high pressure pump to vary the effective pump volume of each pump stroke.

As such, while the direct injection fuel pump is operating, reaching a peak pressure in the compression chamber may ensure lubrication of the direct injection fuel pump. Furthermore, reaching the peak compression chamber pressure may also have a minor cooling effect. However, during conditions when direct injection fuel pump operation is not requested, such as when no direct injection of fuel is requested, and/or when the fuel level in the second fuel tank 212 is below a threshold (that is, there is not enough knock-suppressing fuel available), the direct injection fuel pump may not be sufficiently lubricated if fuel flow through the pump is discontinued.

In alternate embodiments of fuel system 8 of FIG. 2, second fuel tank 212 may be eliminated such that fuel system 8 is a single fuel system with both port and direct fuel injection. Also, more than two fuels may be utilized in other embodiments. Additionally, in other examples, fuel may be supplied only to direct injectors 252 and port injectors 242 may be omitted. In this example system, low pressure fuel pump 208 supplies fuel to direct injection fuel pump 228 via bypass passage 224. Controller 12 adjusts the output of direct injection fuel pump 228 via adjusting a flow control valve of direct injection pump 228. Direct injection pump may stop providing fuel to fuel rail 250 during selected conditions such as during vehicle deceleration or while the vehicle is traveling downhill. Further, during vehicle deceleration or while the vehicle is traveling downhill, one or more direct fuel injectors 252 may be deactivated.

Figure 3:
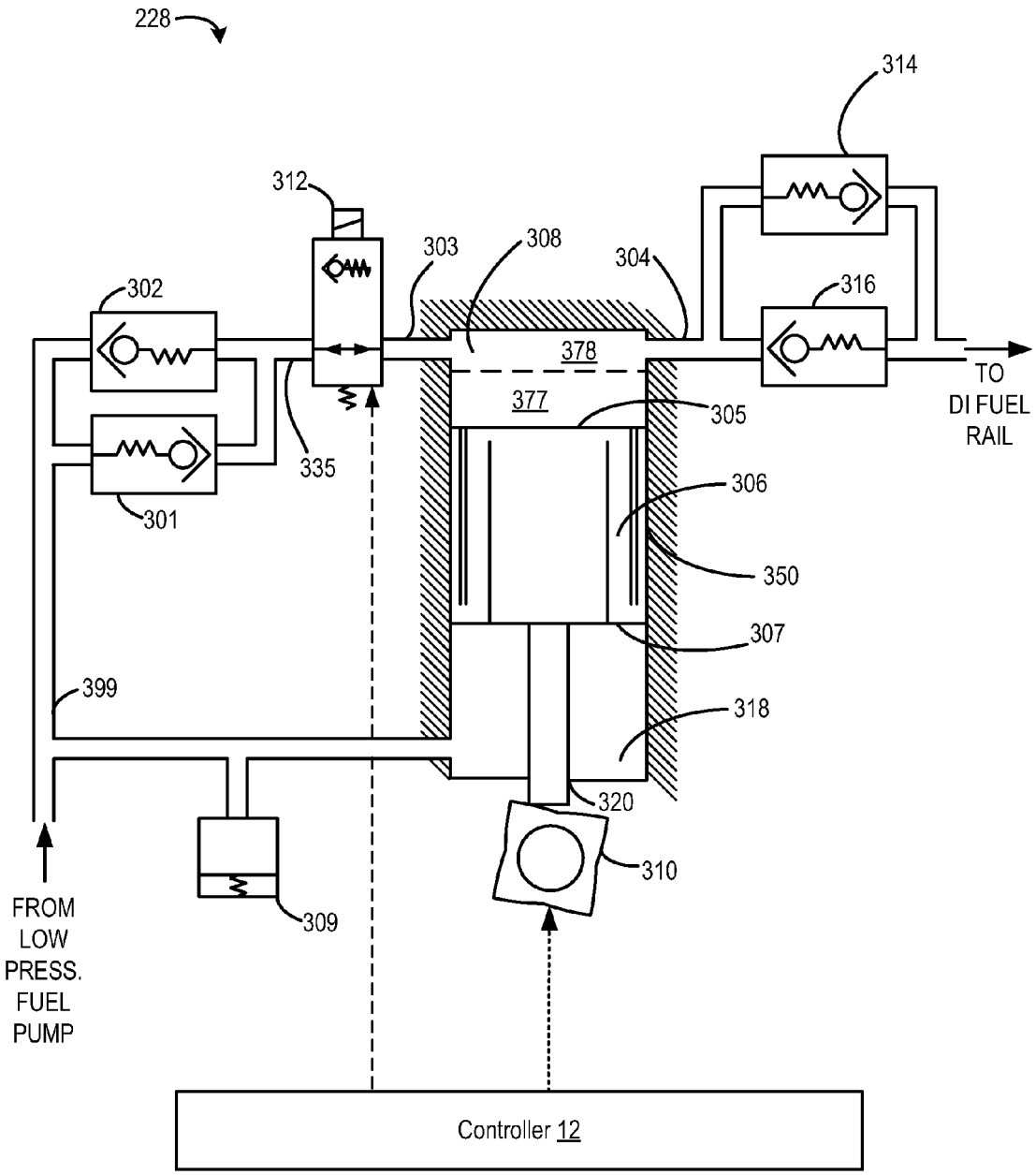
FIG. 3 shows an example of a high pressure direct injection fuel pump of the fuel system of FIG. 2.
Figure 4:
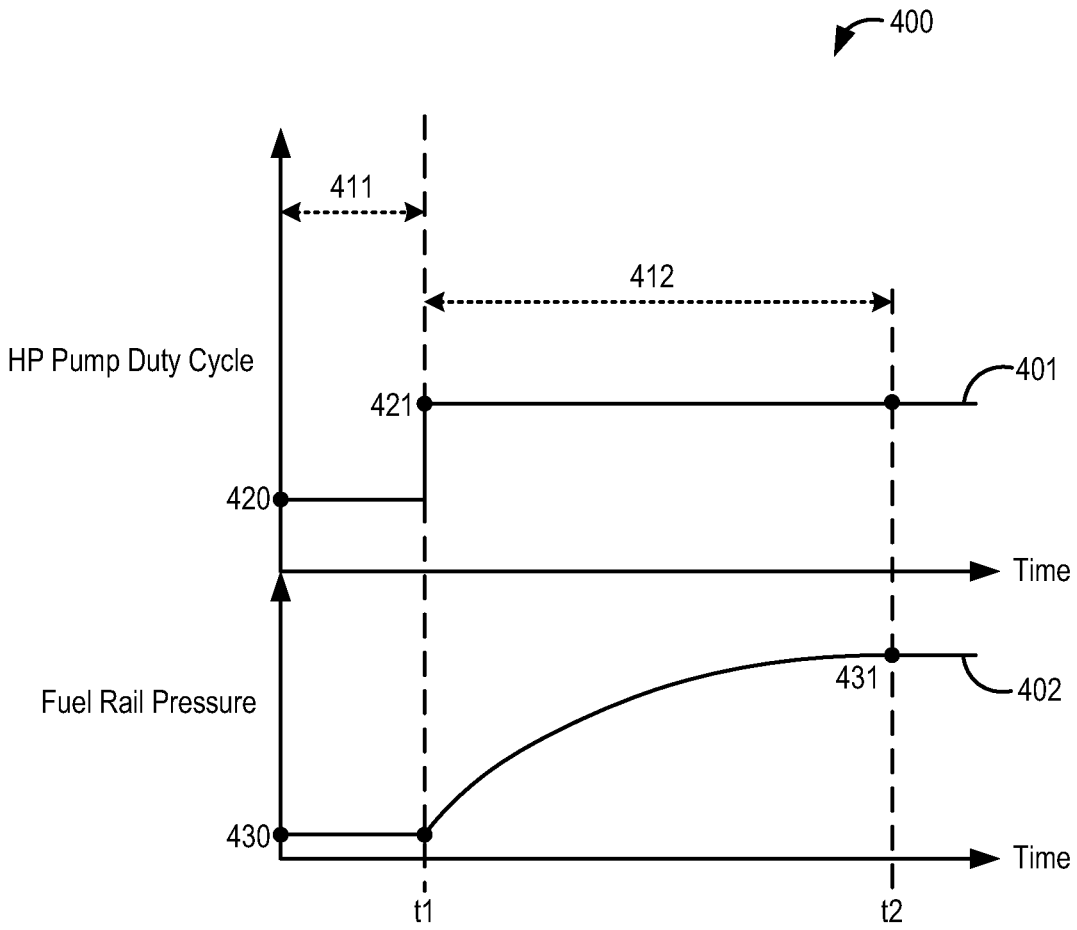
FIG. 4 shows a slow response routine that involves closed loop control.

FIG. 3 shows an example embodiment of the direct injection fuel pump 228 shown in the system of FIG. 2. Inlet 303 of direct injection fuel pump compression chamber 308 is supplied fuel via a low pressure fuel pump as shown in FIG. 2. The fuel may be pressurized upon its passage through direct injection fuel pump 228 and supplied to a fuel rail through pump outlet 304. In the depicted example, direct injection pump 228 may be a mechanically-driven displacement pump that includes a pump piston 306 and piston rod 320, a pump compression chamber 308 (herein also referred to as compression chamber), and a step-room 318. A passage that connects step-room 318 to a pump inlet 399 may include an accumulator 309, wherein the passage allows fuel from the step-room to re-enter the low pressure line surrounding inlet 399. Assuming that piston 306 is at a bottom dead center (BDC) position in FIG. 3, the pump displacement may be represented as displacement 377. The displacement of the DI pump may be measured or estimated as the volume swept by piston 306 as it moves from top dead center (TDC) to BDC or vice versa. A second volume also exists within compression chamber 308, the second volume being a clearance volume 378 of the pump. The clearance volume defines the region in compression chamber 308 that remains when piston 306 is at TDC. In other words, the addition of volumes 377 and 378 form compression chamber 308. Piston 306 also includes a top 305 and a bottom 307. The step-room and compression chamber may include cavities positioned on opposing sides of the pump piston. In one example, engine controller 12 may be configured to drive the piston 306 in direct injection pump 228 by driving cam 310. Cam 310 includes four lobes and completes one rotation for every two engine crankshaft rotations.

A solenoid activated inlet check valve 312, or spill valve, may be coupled to pump inlet 303. Controller 12 may be configured to regulate fuel flow through inlet check valve 312 by energizing or de-energizing the solenoid valve (based on the solenoid valve configuration) in synchronism with the driving cam. Accordingly, solenoid activated inlet check valve 312 may be operated in two modes. In a first mode, solenoid activated check valve 312 is positioned within inlet 303 to limit (e.g. inhibit) the amount of fuel traveling upstream of the solenoid activated check valve 312. In comparison, in the second mode, solenoid activated check valve 312 is effectively disabled and fuel can travel upstream and downstream of inlet check valve.

As such, solenoid activated check valve 312 may be configured to regulate the mass (or volume) of fuel compressed into the direct injection fuel pump. In one example, controller 12 may adjust a closing timing of the solenoid activated check valve to regulate the mass of fuel compressed. For example, a late inlet check valve closing may reduce the amount of fuel mass ingested into the compression chamber 308. The solenoid activated check valve opening and closing timings may be coordinated with respect to stroke timings of the direct injection fuel pump.

Pump inlet 399 allows fuel to check valve 302 and pressure relief valve 301. Check valve 302 is positioned upstream of solenoid activated check valve 312 along passage 335. Check valve 302 is biased to prevent fuel flow out of solenoid activated check valve 312 and into pump inlet 399. Check valve 302 allows flow from the low pressure fuel pump to solenoid activated check valve 312. Check valve 302 is coupled in parallel with pressure relief valve 301. Pressure relief valve 301 allows fuel flow out of solenoid activated check valve 312 toward the low pressure fuel pump when pressure between pressure relief valve 301 and solenoid operated check valve 312 is greater than a predetermined pressure (e.g., 10 bar). When solenoid operated check valve 312 is deactivated (e.g., not electrically energized), solenoid operated check valve operates in a pass-through mode and pressure relief valve 301 regulates pressure in compression chamber 308 to the single pressure relief setting of pressure relief valve 301 (e.g., 15 bar). Regulating the pressure in compression chamber 308 allows a pressure differential to form from piston top 305 to piston bottom 307. The pressure in step-room 318 is at the pressure of the outlet of the low pressure pump (e.g., 5 bar) while the pressure at piston top is at pressure relief valve regulation pressure (e.g., 15 bar). The pressure differential allows fuel to seep from piston top 305 to piston bottom 307 through the clearance between piston 306 and pump cylinder wall 350, thereby lubricating direct injection fuel pump 228.

Piston 306 reciprocates up and down within compression chamber 308. Direct fuel injection pump 228 is in a compression stroke when piston 306 is traveling in a direction that reduces the volume of compression chamber 308. Direct fuel injection pump 228 is in a suction stroke when piston 306 is traveling in a direction that increases the volume of compression chamber 308.

A forward flow outlet check valve 316 may be coupled downstream of an outlet 304 of the compression chamber 308. Outlet check valve 316 opens to allow fuel to flow from the compression chamber outlet 304 into a fuel rail only when a pressure at the outlet of direct injection fuel pump 228 (e.g., a compression chamber outlet pressure) is higher than the fuel rail pressure. Thus, during conditions when direct injection fuel pump operation is not requested, controller 12 may deactivate solenoid activated inlet check valve 312 and pressure relief valve 301 regulates pressure in compression chamber to a single substantially constant (e.g., regulation pressure ±0.5 bar) pressure during most of the compression stroke. On the intake stroke the pressure in compression chamber 308 drops to a pressure near the pressure of the lift pump (208 and/or 218). Lubrication of DI pump 228 may occur when the pressure in compression chamber 308 exceeds the pressure in step-room 318. This difference in pressures may also contribute to pump lubrication when controller 12 deactivates solenoid activated check valve 312. Deactivation of valve 312 may also reduce noise produced by valve 312. One result of this regulation method is that the fuel rail is regulated to a minimum pressure approximately the pressure relief of valve 302. Thus, if valve 302 has a pressure relief setting of 10 bar, the fuel rail pressure becomes 15 bar because this 10 bar adds to the 5 bar of lift pump pressure. Specifically, the fuel pressure in compression chamber 308 is regulated during the compression stroke of direct injection fuel pump 228. Thus, during at least the compression stroke of direct injection fuel pump 228, lubrication is provided to the pump. When direct fuel injection pump enters a suction stroke, fuel pressure in the compression chamber may be reduced while still some level of lubrication may be provided as long as the pressure differential remains. Another check valve 314 (pressure relief valve) may be placed in parallel with check valve 316. Valve 314 allows fuel flow out of the DI fuel rail toward pump outlet 304 when the fuel rail pressure is greater than a predetermined pressure.

It is noted here that DI pump 228 of FIG. 3 is presented as an illustrative example of one possible configuration for a DI pump. Components shown in FIG. 3 may be removed and/or changed while additional components not presently shown may be added to pump 228 while still maintaining the ability to deliver high-pressure fuel to a direct injection fuel rail. As an example, pressure relief valve 301 and check valve 302 may be removed in other embodiments of fuel pump 228. Furthermore, the methods presented hereafter may be applied to various configurations of pump 228 along with various configurations of fuel system 8 of FIG. 2. In particular, the zero flow lubrication methods described below may be implemented in various configurations of pump 228 without adversely affecting normal operation of the pump 228. In this way, the zero flow lubrication methods may be versatile and adapted to a variety of fuel and HP pump systems.

Direct injection fuel pumps such as pump 228 of FIG. 3 may require a minimum amount of lubrication to remain useable and to inhibit the amount of wear that occurs between the piston and bore of the pump. Without sufficient lubrication, the interface between piston 306 and cylinder wall 350 (the bore of the pump) may be subjected to material removal (degradation) due to friction between the piston and cylinder wall as the piston reciprocates. During times when direct injection is not requested, such as when only port fuel injection is requested, pump durability may be affected. Specifically, the lubrication and cooling of the pump may be reduced while the high pressure pump is not operated, thereby leading to pump degradation. Therefore, it may be beneficial to continue operation of the high pressure pump even when direct injection is not requested. As such, operation of the high pressure pump may be adjusted to maintain a pressure at the outlet of the high pressure pump at or below the fuel rail pressure of the direct injection fuel rail. By maintaining the outlet pressure of the high pressure pump just below the fuel rail pressure, without allowing fuel to flow out of outlet 304 of the HP pump into the fuel rail, the HP pump may be kept lubricated, thereby reducing pump degradation. This general operation may be referred to as zero flow lubrication (ZFL). It is noted that other similar schemes may be implemented that maintain lubrication of the high pressure pump while fuel is not pumped into the direct injection fuel rail. For example, fuel rail pressure may be incrementally increased instead of being held constant in a different ZFL scheme.

During zero flow lubrication, outlet check valve 316 may prevent fuel flow out of the HP pump and into the fuel rail as long as the outlet pressure is below the fuel rail pressure. To verify operation of the check valve, as well as to confirm that the pump outlet is at the desired lubrication level, a stroke amount of the HP pump may be pulsed, or intermittently increased, to allow a small amount of fuel to flow across check valve 316, out of the outlet of the HP pump into the fuel rail. If check valve 316 is operational and the pump outlet pressure is at the desired lubrication level, the adjusted stroke amount and the fuel flow across the check valve may cause a corresponding increase in the fuel rail pressure. In response to the pulse in the fuel rail pressure, the stroke amount of the HP pump may be immediately decreased to a stroke amount that does not affect the fuel rail pressure.

By intermittently pulsing the HP pump outlet pressure to look for corresponding pulses in fuel rail pressure, check valve operations may be verified, while also confirming that the HP pump outlet pressure is at a level that enables sufficient pump lubrication and cooling (that is, at a level just below the fuel rail pressure). By adjusting the stroke amount of the HP pump to a greater and/or a lesser stroke amount during conditions when HP pump operation is not requested, pump lubrication may be achieved without necessitating additional components for flow diversion and flow control, although these may be included if desired. By reducing non-use of the high pressure pump, and maintaining high pressure pump lubrication and/or cooling via zero flow lubrication, pump degradation may be reduced.

Zero flow lubrication (ZFL) may be performed by an HP pump to produce data that may be used to enhance pump and/or engine performance. One method to perform zero flow lubrication, as further explained below, exhibits slow response times, and therefore is hereafter referred to as a slow ZFL test. The purpose of the slow ZFL test may be to generate data that corresponds to zero flow data, that is, data when substantially no fuel or no fuel is being pumped out of compression chamber 308 and into the DI fuel rail by the HP pump. The slow ZFL test, fully explained below, operates by incrementally increasing duty cycle of the HP pump and waiting for a steady-state response fuel rail pressure. This routine is shown in FIG. 4 as slow response routine 400. In routine 400 as shown by the graph of FIG. 4, two plots are shown. The first plot, HP pump duty cycle, or closing of the spill valve, is shown as plot 401. The second plot, fuel rail pressure of the DI fuel rail, is shown as plot 402. In both plots time is represented along the horizontal axis.

Referring to FIG. 4, initially at the start of routine 400, during a time interval represented by interval 411, the HP pump maintains a substantially constant duty cycle 420 while the fuel rail pressure is maintained at a substantially constant fuel rail pressure 430. At time t1, a first pump duty cycle 421 is commanded, which is an increase from constant duty cycle 420. The first pump duty cycle 421 is held constant in between times t1 and t2. During this interval, represented as interval 412, the fuel rail pressure responds and gradually increases compared to the immediate increase in pump duty cycle. Ideally, the fuel rail pressure would respond in the same fashion as the HP pump duty cycle. Due to the slow response of fuel rail pressure, interval 412 may be as long as 10 seconds, or until the fuel rail pressure reaches a substantially steady-state value. After interval 412 has elapsed, the first duty cycle 421 may be recorded (measured) along with steady-state fuel rail pressure 431. The slow aspect of slow response routine 400 is a result of interval 412 being as long as 10 seconds or longer. Routine 400, wherein a constant duty cycle 421 is commanded and held (maintained) until fuel rail pressure reaches a steady-state value 431 without feedback from the responsive FRP may be referred to as open loop control. An open loop control scheme may control pump duty cycle command without FRP feedback. As seen later, the difference between open and closed loop control is presented.

Determining parameters such as duty cycle and fuel rail pressure in routine 400 and other methods described below may include using various sensors attached to controller 12, such as one or more of fuel mass sensors, fuel volume sensors, fuel pressure sensors, etc. located in various parts of the fuel system. For example, fuel rail pressure may measured by a pressure sensor that is connected to a controller with computer readable instructions stored in non-transitory memory for executing the open and/or closed loop control schemes. Other sensor arrangements are possible for attaining the necessary data for other methods.

Figure 5:
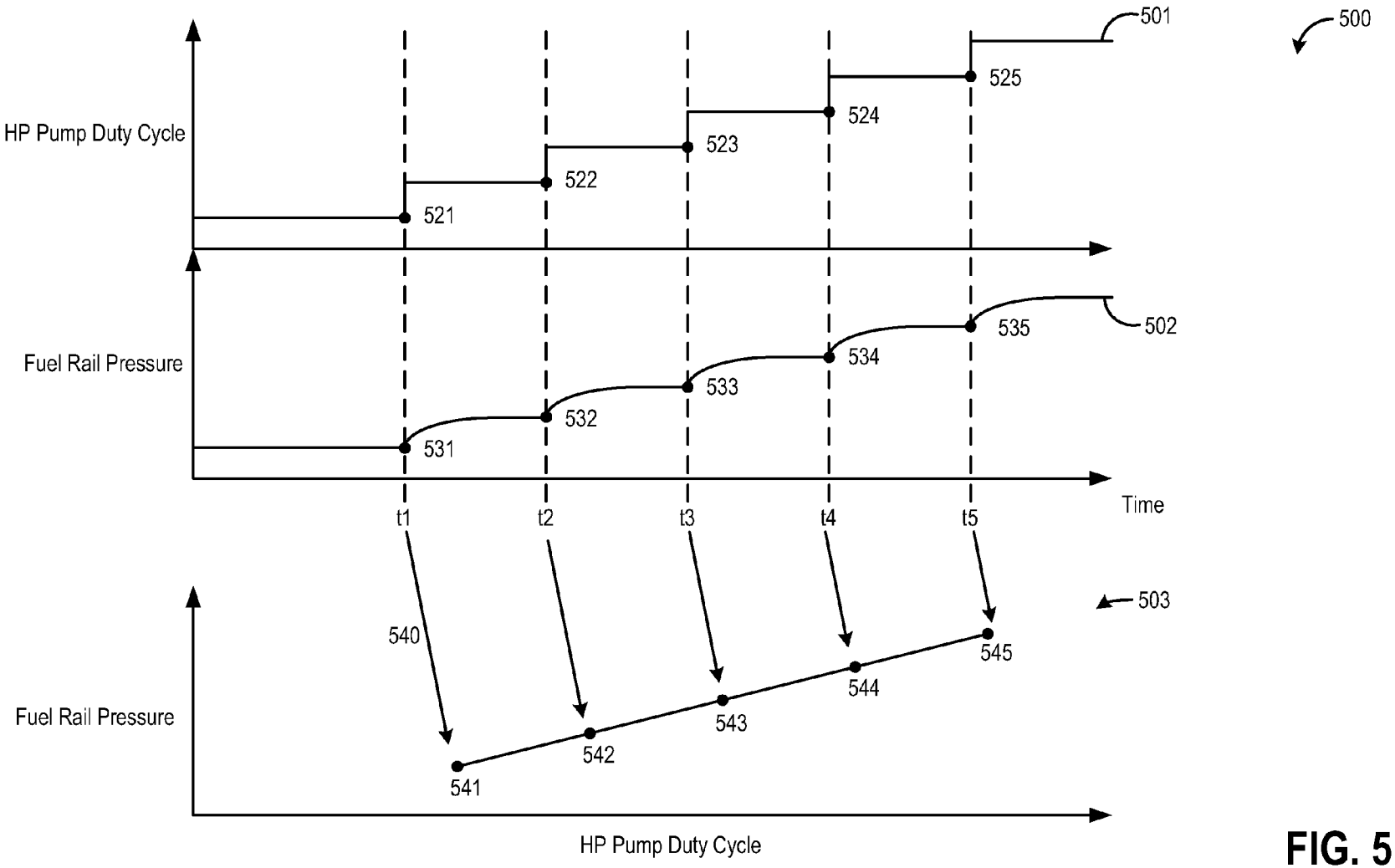
FIG. 5 depicts a slow zero flow lubrication test that involves repeated cycles of the routine of FIG. 4.
Figure 6:
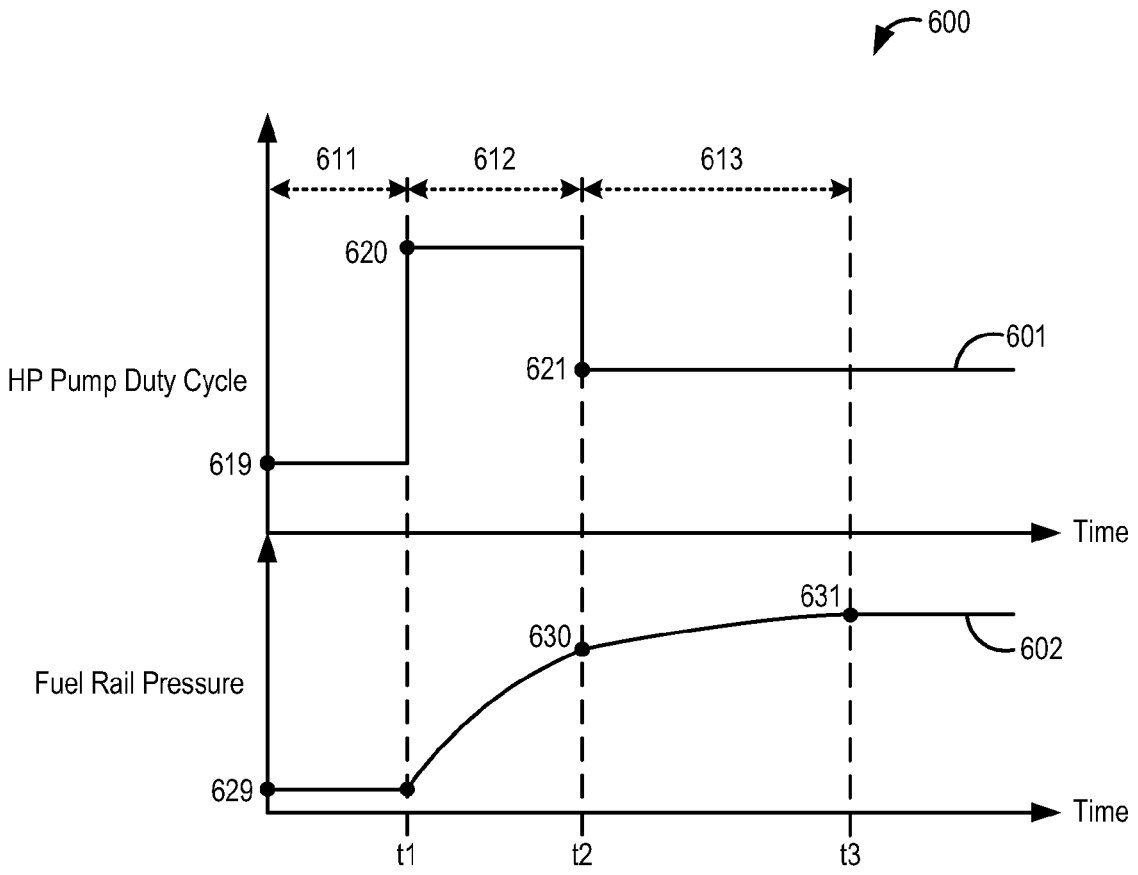
FIG. 6 shows a fast response routine that involves both open and closed loop control.

The slow ZFL test, used to attain zero flow rate data, is shown graphically in FIG. 5. Slow ZFL test 500 involves repeating routine 400 of FIG. 4 to gain multiple data points, each data point comprising duty cycle and a fuel rail pressure. Routine 400 finds one data point, containing duty cycle 421 and fuel rail pressure 431, whereas slow ZFL test finds multiple data points. In this ZFL test, data is gathered while not direct injecting fuel into the engine, also known as zero injection flow rate. Furthermore, since HP pump duty cycle during ZFL conditions may be dependent on engine (and HP pump) speed, a substantially constant engine idling speed may be desired during the slow ZFL test (or method). As such, in engines that utilize both port and direct fuel injection, an engine may be put into a stabilized idling condition with a substantially constant speed where direct injection is not requested and there is no fuel being pumped into the fuel rail that is coupled to HP pump 228. Test 500 shows commanded changes in pump duty cycle in plot 501 and the responsive changes in fuel rail pressure in plot 502. In plots 501 and 502 time is represented along the horizontal axis. Plot 503 shows how fuel rail pressure changes as a function of pump duty cycle. Plot 503 may also be referred to as the zero flow function, in that plot 503 shows a relationship between fuel rail pressure and duty cycle with a 0 flow rate since the HP pump is not sending fuel into the fuel rail.

The sequence of events according to method 500 of FIG. 5 is as follows: first, prior to time t1, pump duty cycle is being nominally controlled and thereby creating a response in fuel rail pressure. At time t1, a first pump duty cycle 521 is commanded and recorded along with the corresponding fuel rail pressure 531. Upon recording the values, duty cycle is increased to 522 and held for a time in between times t1 and t2. During this interval, similarly represented as interval 412 in FIG. 4, the fuel rail pressure responds and gradually increases compared to the immediate increase in pump duty cycle. Due to the slow response of fuel rail pressure, the time interval to wait before taking second recordings may be 10 seconds, or until the fuel rail pressure reaches a steady-state value. After a time interval has elapsed (such as 10 seconds), the increased duty cycle 522 is recorded along with the steady-state fuel rail pressure 532 at time t2. The duty cycle is again incrementally increased to 523 and a similar amount of time elapses before recording duty cycle 523 and the responsive steady-state fuel rail pressure 533 at time t3. As seen in FIG. 6, this same process is repeated at times t4 and t5. Notice that routine 400 of FIG. 4, in particular interval 412, is repeated in FIG. 5 during intervals t1-t2, t2-t3, t3-t4, and t4-t5. In this example method, five data points are recorded, each data point including a duty cycle value and a fuel rail pressure value as previously mentioned.

Since each of the data points contains two values (duty cycle and fuel rail pressure), the five data points may be plotted on the separate graph 503 where HP pump duty cycle is the horizontal axis and fuel rail pressure is the vertical axis. Each data point is plotted as its corresponding point on graph 503. For example, the data point containing duty cycle 521 and fuel rail pressure 531 is plotted as point 541 on graph 503, as directed by arrow 540. Points 541, 542, 543, 544, and 545 may lie along a straight line, and the straight line may be extended according to a slope of the line. Zero flow function 503 may be used to find data that may enhance pump performance, such as correcting timing errors in solenoid activated inlet check valve and determining various system properties such as the bulk modulus of the fuel pumped through the HP pump.

The inventors herein have recognized that the accumulation of response times between times t1 and t5 of FIG. 5 may create several issues when implementing slow ZFL test 500 in a fuel system. For example, if ten data points were desired to create zero flow function 503, and the response time for the fuel rail pressure were 10 seconds, then at least 90 seconds would be required each time slow ZFL test 500 were initiated. As mentioned previously, test 500 is conducted during times when no direct injection is requested, such as during engine idling times when port fuel injection may be utilized in engine systems with both types of injection systems. If a vehicle operator performs engine idle, such as at stoplights or before driving upon starting the vehicle, in times less than the required 90 seconds, then test 500 may only be performed less often than desired.

Furthermore, another issue associated with 10-second response times between incrementing the HP pump duty cycle and measuring FRP may be that a small fuel rail temperature change during the 10-second period results in a FRP pressure change independent of the duty cycle increment. As such, it may difficult to differentiate the FRP change due to the duty cycle increase from the FRP change due to temperature change of the contained fuel in the fuel rail. In light of these issues, a faster ZFL test is needed that requires less time to acquire enough data to create zero flow function 503.

Furthermore, the inventors herein have identified a potential source of the long fuel rail pressure response times. During zero flow lubrication operation, such as that described by slow ZFL test 500, small HP pump duty cycles may be commanded. Since the objective of zero flow lubrication in HP pumps may be to maintain lubrication past the piston-bore interface without pumping fuel into the direct injection fuel rail, or maintaining a pressure at or slightly below the fuel rail pressure, smaller duty cycles may be commanded compared to duty cycles required when direct injection is requested. A small duty may correspond to duty cycles ranging from about 1% to 8%. For example, if the duty cycle is 5%, then 95% of the fuel volume is spilled. In other words, 5% of the volume of fuel ingested into the pump compression chamber is compressed by the piston, where the remaining 95% is flows backward out of the compression chamber past the solenoid activated inlet check valve. Due to the small duty cycles, the DI pump may be utilizing a small portion of its full displacement to compress the small amount of fuel. Another volume, a displaced fuel volume, may be defined that represents the volume of the DI pump's full displacement that is used to compress the small amount of fuel. As previously explained, clearance volume 378 (or dead volume) is a constant value of the DI pump. A volume ratio may be defined that compares clearance volume to displaced volume (clearance volume divided by displaced volume). For example, when a 100% is commanded, the volume ratio may be a minimum, since displaced volume=displacement as a 100% duty cycles corresponds to a full compression stroke. As the displaced volume may decrease with decreasing duty cycle, the volume ratio may increase accordingly. When small duty cycles are commanded (such as 1% to 8%), the volume ratio becomes large, which physically corresponds to a small amount of fuel being pumped. In this way, fuel rail pressure takes a relatively long time to respond to the small duty cycles, as each time the pump performs a compression stroke a small amount of fuel is being pumped into the fuel rail. If the duty cycle was relatively larger, each cycle of the pump would force a larger amount of fuel into the fuel rail, and therefore raise the pressure faster. From this, it can be seen that commanding a constant, small duty cycle and waiting for the responsive fuel rail pressure to ready a steady-state may not be the best approach to zero flow lubrication tests.

A proposed rapid ZFL test may involve two separate pressure control schemes that may aid in reducing the response time of the fuel rail pressure upon change in duty cycle of the high pressure pump. In this context, the faster aspect of the rapid ZFL test may involve shorter time intervals in between responsive fuel rail pressures than the slow ZFL test 500. The rapid ZFL test, fully explained below, operates by increasing duty cycle above a desired or target duty cycle, waiting for a fuel rail pressure increase, then decreasing to the desired duty cycle and again waiting for fuel rail pressure to reach a steady-state value. This routine, shown as rapid response routine 600 in FIG. 6, performs both open and closed loop control to increase response time between fuel rail pressures. In routine 600 as shown by the graph in FIG. 6, two plots are shown. The first plot, HP pump duty cycle, or closing of the spill valve, is shown as plot 601. The second plot, fuel rail pressure of the DI fuel rail, is shown as plot 602. In both plots time is represented along the horizontal axis.

Referring to FIG. 6, initially at the start of routine 600, during a time interval represented by interval 611, the HP pump maintains a substantially constant duty cycle 619 while the fuel rail pressure is maintained at a substantially constant fuel rail pressure 629. It is noted that other duty cycle behavior and/or fuel rail pressure behavior may be present during interval 611, but for the sake of simplicity, both values are held constant during this time period. For routine 600, the end result may be a desired (or target) duty cycle 621 and a corresponding target fuel rail pressure 631. Based on previous zero flow data or other similar data stored in controller 12, the controller may predict target fuel rail pressure 631 that may result from the commanded duty cycle increment to target duty cycle 621. As such, at time t1, a first pump duty cycle 620 is commanded, which is an increase from constant duty cycle 619. First duty cycle 620 may be larger than target duty cycle 621. The first pump duty cycle 620 is held for a time interval 612, between times t1 and t2. During interval 612, the fuel rail pressure responds and gradually increases compared to the immediate increase in pump duty cycle. As predicted fuel rail pressure 631 is known by the controller, an intermediate fuel rail pressure 630 may be calculated, wherein intermediate fuel rail pressure 630 may be a certain percentage of predicted fuel rail pressure 631, such as 85%. For example, if the predicted FRP is 4 bar, the intermediate FRP would be 3.4 bar. In routine 600, once the fuel rail pressure reaches intermediate fuel rail pressure 630 at time t2, then duty cycle decreases to target duty cycle 621 and is held constant. The fuel rail pressure responds accordingly and increases during time interval 613 until predicted fuel rail pressure 631 is reached at time t3. After interval 413 has elapsed, duty cycle 621 may be recorded (measured) along with steady-state (predicted) fuel rail pressure 631.

As seen in FIG. 6, FRP increases at a faster rate during interval 612 than during interval 613. The reason for this, as mentioned previously, is that fuel rail pressure increases faster when a higher duty cycle is commanded. Consequently, duty cycle 620 in interval 612 is higher than duty cycle 621 in interval 613. In other words, the slope of fuel rail pressure plot 602 is greater during interval 612 than during interval 613. Furthermore, similar to routine 400, routine 600 performs open loop control where a constant duty cycle 621 is held until fuel rail pressure reaches a steady-state value 631 during interval 613. However, unlike routine 400 which only performs open loop control, routine 600 also performs closed loop control during interval 612. Per the closed loop control, the controller or other commanding device may recognize that the desired duty cycle is 621 but initially commands a higher duty cycle 620 so that FRP may increase at a faster rate in between times t1 and t2. Once FRP reaches a percentage of the predicted value, then control switches from closed to open loop, and a lower duty cycle 621 may be commanded until FRP increases to steady-state FRP 631. In this way, the time in between times t1 and t3, the addition of intervals 612 and 613, may be less than interval 412 of FIG. 4. For example, routine 600, measured between times t1 and t3, may take 3 seconds whereas routine 400, measured between times t1 and t2, may take as long as 10 seconds.

It is noted that the specific shape of plots 601 and 602 of routine 600 may be different than shown in alternative embodiments of utilizing both open and closed loop control. In one example, during closed loop control (interval 612) if the FRP is not responding as fast as required by the scheme, then duty cycle may be increased multiple times during interval 612 before switching to open loop control at time t2. To accomplish this, FRP may be continually measured to determine if the closed loop control scheme should further increase duty cycle. In this situation, rather than remaining constant during interval 612, duty cycle may be increased from 620 to one or more elevated values before decreasing to duty cycle 621 at time t2. In this way, the closed loop control scheme may increment HP pump duty cycle with feedback from the responsive FRP. Furthermore, in other embodiments, the relative size between intervals 612 and 613 may be different than that shown in FIG. 6 depending on desired FRP response times and other similar factors. For example, if the percentage of predicted FRP 631 that defines FRP 630 were larger than 85%, such as 95%, then the interval sizes may change such that interval 612 were larger than interval 613. Also, the slopes of plot 602 (rate of FRP change), may be different than those shown while the slope during interval 612 remains steeper than the slope during interval 613. Routine 600 is meant to be an illustrative example of a HP pump ZFL scheme wherein both closed loop and open loop controls are used to increment duty cycle and fuel rail pressure.

Figure 7:
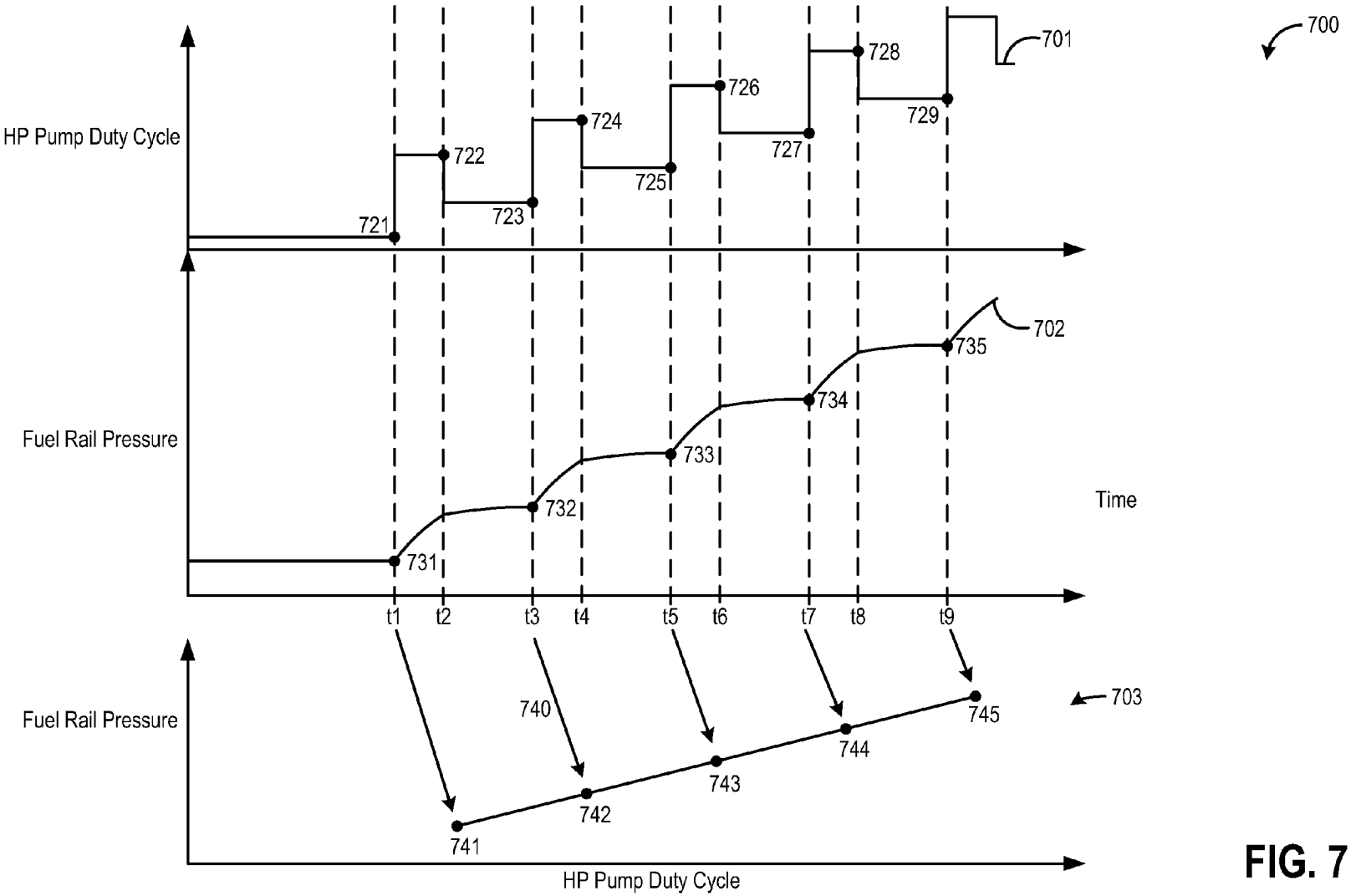
FIG. 7 depicts a rapid zero flow lubrication test that involves repeated cycles of the routine of FIG. 6.
Figure 8:
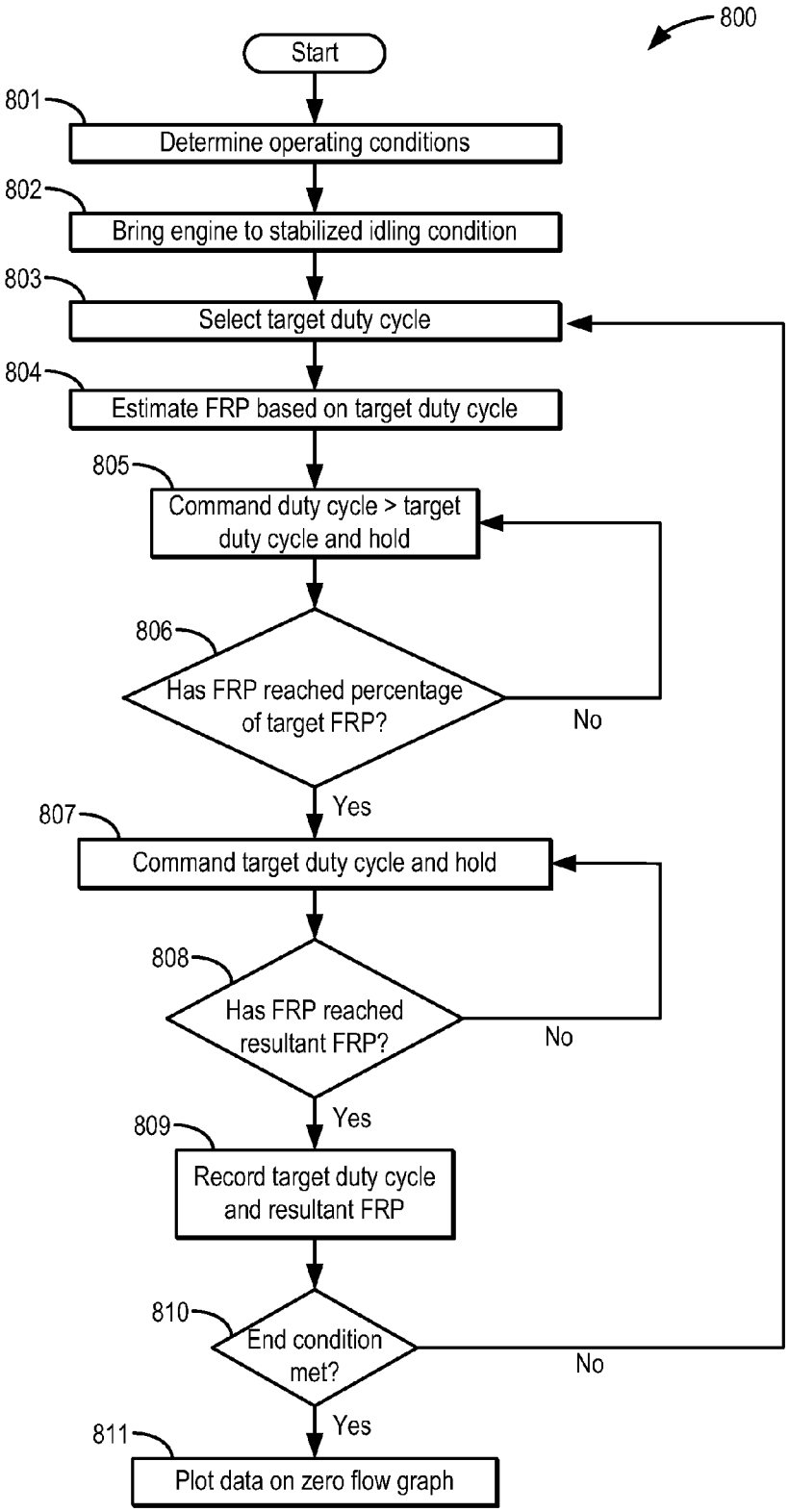
FIG. 8 depicts a flow chart of a rapid zero flow lubrication test for generating zero flow data.

The rapid ZFL test, used to attain zero flow rate data, is shown graphically in FIG. 7. Rapid ZFL test 700 involves continually repeating routine 600 of FIG. 6 to gain multiple data points, each data point comprising a duty cycle and a fuel rail pressure. Routine 600 may find a single data point, containing duty cycle 621 and fuel rail pressure 631 whereas rapid ZFL test 700 may find a multitude of data points. During rapid ZFL 700, data is gathered while not direct injecting fuel into the engine, also known as zero injection flow rate. Furthermore, since HP pump duty cycle during ZFL conditions may be dependent on engine (and HP pump) speed, a substantially constant engine idling speed may be desired during the rapid ZFL test (or method). In engines that utilize both port and direct fuel injection, an engine may be put into a stabilized idling condition where direct injection is not requested and there is no fuel being pumped into the fuel rail that is coupled to HP pump 228. In some engines, ceasing direct injection may also include providing fuel to the engine via port injection only. Test 700 shows commanded changes in pump duty cycle in plot 701 and the responsive changes in fuel rail pressure in plot 702. In plots 701 and 702 time is represented along the horizontal axis. Plot 703 shows how fuel rail pressure changes as a function of pump duty cycle. Plot 703 may also be referred to as the zero flow function, in that plot 703 shows a relationship between fuel rail pressure and duty cycle with a 0 flow rate since the HP pump is not sending fuel into the fuel rail.

The sequence of events according to method 700 of FIG. 7 is as follows: first, prior to time t1, pump duty cycle is being nominally controlled and thereby creating a response in fuel rail pressure. At time t1, a first pump duty cycle 721 is commanded and recorded along with the corresponding fuel rail pressure 731. Upon recording the values, duty cycle is increased to 722 and held for a time in between times t1 and t2. Similar to FIG. 6, a target duty cycle 723 may be known while a predicted fuel rail pressure 732 may be calculated. As such, duty cycle 722 is larger than duty cycle 723. Duty cycle may be controlled by the aforementioned open loop control from time t1 to time t2. Once the FRP reaches a percentage of the predicted FRP 732, such as 85%, duty cycle may be decreased to 723 and held from time t2 to time t3 according to closed loop control until FRP increases to predicted FRP 732. At this point, duty cycle 723 and fuel rail pressure 732 may be recorded. Next, the duty cycle is again incrementally increased to 724 at time t3 during open loop control and a similar amount of time elapses (from t3 to t4) before switching again to closed loop control at time t4. As seen in FIG. 7, this same process, routine 600, is repeated at times t5 and t7. Notice that routine 600 of FIG. 6, in particular the combined interval (addition of intervals 612 and 613), is repeated in FIG. 7 during intervals t1-t3, t3-t5, t5-t7, and t7-t9. In this example method, five data points are recorded, each data point including a duty cycle value and a fuel rail pressure value as previously mentioned. The collection of data points may be referred to as a dataset which may be plotted to form a graph, as described below.

Since each of the data or points contains two values (duty cycle and fuel rail pressure), the five data points may be plotted on the separate graph 703 where HP pump duty cycle is the horizontal axis and fuel rail pressure is the vertical axis. Each data point is plotted as its corresponding point on graph 703. For example, the data point containing duty cycle 723 and fuel rail pressure 732 is plotted as point 742 on graph 703, as directed by arrow 740. Points 741, 742, 743, 744, and 745 may lie along a straight line, and the straight line may be extended according to a slope of the line. Zero flow function 703 may be used to find data that may enhance pump performance, such as correcting timing errors in solenoid activated inlet check valve and determining various system properties such as the bulk modulus of the fuel pumped through the HP pump, similar to zero flow function 503 of FIG. 5.

It can be seen that the graphs shown in FIGS. 5 and 7 are similar in that both generate zero flow data (with five points) and zero flow functions 503 and 703, respectively. The main difference between the two is that rapid ZFL test 700 may generate the zero flow data faster than slow ZFL test 500. For example, as previously mentioned, to collect ten data points using slow ZFL test 500, then at least 90 seconds may be required. If the rapid ZFL test were performed using similar duty cycle increments, where each individual routine may take about 3 seconds, then about 27 seconds may be required. As such, the rapid ZFL test may require about one third as much time as the slow ZFL test. By requiring less time, the rapid ZFL test may be performed more often during idling conditions of the engine, such as when no direct injection is requested. By switching between open and closed loop control as during the rapid ZFL test, zero flow data may be gathered faster than utilizing only open loop control such as during the slow ZFL test. Also, it is noted that all or a portion of the slope of plot 602 of FIG. 6 may be higher than the slope of plot 402 of FIG. 4, or the rate of FRP increase of FIG. 6 is greater than the rate of FRP increase of FIG. 6. A flow chart illustrating the process of the rapid ZFL test can be seen in FIG. 8.

FIG. 8 shows a flow chart for the rapid ZFL test 800. Beginning at 801, a number of operating conditions for the fuel and engine system may be determined. These vary depending on the particular system, and may include factors such as current engine speed, engine fuel demand, boost, driver demanded torque, engine temperature, air charge, an end condition, a percentage of the target fuel rail pressure, etc. Second, at 802, the engine may be brought into a stabilized idling condition, wherein direct injection is not requested and the fuel is not direct injected into the engine. This condition may include injecting the engine via port fuel injection only to maintain engine idle speed. Furthermore, the stabilized idling condition of step 802 may be present through all succeeding steps 803-811, such that if idling is terminated, then method 800 may also terminate. At 803, the method includes selecting a duty cycle that will be commanded in a later step. The duty cycle is a target duty cycle for the HP pump and may be selected based on the estimated operating conditions. Next, at 804, a target fuel rail pressure may be estimated by a device such as controller 12, where the target fuel rail pressure may be referred to as the predicted fuel rail pressure as described previously. The estimated target fuel rail pressure may be based on the duty cycle of step 803, where the controller may contain previous HP pump operation data and/or test data that shows what fuel rail pressure is expected from a certain duty cycle increment. The previous test data and expected values may be stored in a look-up table of the controller as a function of duty cycle.

At 805, a higher duty cycle than the target duty cycle of step 803 may be commanded and held constant, thereby initiating the aforementioned closed loop control. At this time, due to the elevated duty cycle, fuel rail pressure may respond and increase accordingly. Next, step 806 may determine whether or not fuel rail pressure has reached a percentage of the target fuel rail pressure. If the FRP has not reached the percentage, then step 805 may be repeated, where the higher duty cycle is held constant while FRP increases. In another embodiment, upon repeating step 805 a higher duty cycle may be commanded than the previous duty cycle. Conversely, at step 806, if the FRP has reached the percentage of the target fuel rail pressure, then at 807 the target duty cycle of step 803 may be commanded, the target duty cycle being lower than the higher duty cycle. During this step, FRP may continue to increase, though not at the same rate as in step 805.

Next, step 808 may determine whether or not fuel rail pressure has reached a resultant fuel rail pressure, or steady-state FRP where there is substantially no change in the FRP. If the FRP is not equal to the resultant FRP, then step 807 may be repeated, where the target duty cycle is held constant while FRP increases. Conversely, if the FRP has reached the resultant FRP, then at 809 the resultant FRP and target duty cycle may be recorded. Subsequently, at 810, an end condition may be met to progress to the next step. The end condition may be a minimum amount of data gathered, where each data point comprises a duty cycle and FRP. Alternatively, the end condition may be a minimum amount of elapsed time for collecting data or reaching an upper duty cycle threshold. Before that condition is met, several steps are repeated as seen in FIG. 8 to gather more data, each with a continually increasing commanded target duty cycles. For example, during a second execution of the process according to step 810, the selected target duty cycle of step 803 would be larger than the previous target duty cycle. This can be seen graphically as the difference between duty cycles 725 and 727 of FIG. 7, for example. In this way, the process of estimating target FRP then performing the closed and open loop controls schemes in steps 803-809 may be repeated while incrementally increasing duty cycle of the HP pump. Finally, once the end condition is met, the gathered data may be plotted on a zero flow graph at 811, wherein the horizontal axis is duty cycle and vertical axis if FRP. It is noted that collecting more data points in steps 803-809 may increase the accuracy of the line formed by those data points as plotted in step 811.

Summarizing, the closed loop control scheme increments duty cycle of the HP pump with feedback from a responsive fuel rail pressure. Conversely, the open loop control scheme maintains a fixed duty cycle of the HP pump without feedback from a responsive fuel rail pressure. In other words, the open loop control scheme may operate independent of feedback FRP signals provided to the closed loop control scheme. By alternating these two control schemes, quicker FRP response times may be generated which may lead to quicker zero flow lubrication tests. The routine, such as routine 600, may estimate the target fuel rail pressure by analyzing duty cycle and fuel rail pressure data from previous HP pump operation. For example, a duty cycle increment and the responsive FRP increase may be stored in controller 12, where that data may be compared to the present test in order to predict (estimate) the target fuel rail pressure that results from a certain duty cycle increase. To increase the amount of zero flow rate data, the processes involved with rapid ZFL test 700, such as estimating the target fuel rail pressure and performing the closed and open loop control schemes, may be repeated while incrementally increasing duty cycle of the HP pump to form the continually increasing plots 701 and 702 of FIG. 7. It is noted that both the open and closed loop control schemes may be executed by a form of computerized device, such as controller 12 with computer readable instructions stored in non-transitory memory.

In this way, by integrating the rapid ZFL test as previously described, zero flow data may be attained at a faster rate than other tests such as the slow ZFL test. As such, the rapid ZFL test may be executed more often than slower ZFL tests since the rapid ZFL test may be performed during brief engine idling conditions, such as when no direct injection is requested. Furthermore, as more zero flow data may be attained in a shorter time period than other methods, the rapid ZFL test may allow zero flow lubrication of the HP pump to be better controlled.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

while not direct injecting fuel into an engine and while the engine is in a stabilized idling condition;

estimating a target fuel rail pressure based on a commanded target duty cycle of a high pressure fuel pump;

performing a closed loop control scheme until fuel rail pressure reaches a percentage of the target pressure; and performing an open loop control scheme until fuel rail pressure reaches the target fuel rail pressure.

2. The method of claim 1, wherein the closed loop control scheme increments duty cycle of the high pressure fuel pump with feedback from a responsive fuel rail pressure.

3. The method of claim 2, wherein the responsive fuel rail pressure is measured by a pressure sensor that is connected to a controller with computer readable instructions stored in non-transitory memory for executing the closed loop control scheme.

4. The method of claim 1, wherein the open loop control scheme maintains a fixed duty cycle of the high pressure fuel pump without feedback from a responsive fuel rail pressure.

5. The method of claim 4, wherein the open loop control scheme is executed by a controller with computer readable instructions stored in non-transitory memory.

6. The method of claim 1, wherein the percentage of the target pressure is 85%.

7. The method of claim 1, wherein estimating the target fuel rail pressure involves analyzing duty cycle and fuel rail pressure data from previous high pressure fuel pump operation.

8. The method of claim 1, wherein estimating the target fuel rail pressure and performing the closed and open loop control schemes is repeated while incrementally increasing duty cycle of the high pressure pump.

9. A method, comprising:

while not direct injecting fuel into an engine:

estimating a target fuel rail pressure based on a commanded target duty cycle of a high pressure fuel pump;

performing a closed loop and open loop control scheme until fuel rail pressure reaches the target fuel rail pressure;

increasing the target duty cycle of the high pressure pump and performing the closed and open loop control schemes again; and continue increasing pump duty cycle incrementally and determining responsive fuel rail pressure until an upper duty cycle threshold is reached.

10. The method of claim 9, further comprising plotting a dataset to form a graph, the dataset including a multitude of data points, each data point including a duty cycle of the high pressure fuel pump and a fuel rail pressure.

11. The method of claim 10, wherein the graph includes duty cycle of the high pressure fuel pump as a horizontal axis and fuel rail pressure as a vertical axis.

12. The method of claim 9, wherein the closed loop control scheme increments duty cycle of the high pressure fuel pump based on a responsive fuel rail pressure.

13. The method of claim 12, wherein the responsive fuel rail pressure is measured by a pressure sensor that is connected to a controller with computer readable instructions stored in non-transitory memory for executing the closed loop control scheme.

14. The method of claim 9, wherein the open loop control scheme maintains a fixed duty cycle of the high pressure fuel pump without feedback from a responsive fuel rail pressure.

15. The method of claim 14, wherein the open loop control scheme is executed by a controller with computer readable instructions stored in non-transitory memory.

16. The method of claim 9, wherein the percentage of the target pressure is 85%.

17. The method of claim 9, wherein estimating the target fuel rail pressure involves analyzing duty cycle and fuel rail pressure data from previous high pressure fuel pump operation.

18. A fuel system, comprising:

one or more direct fuel injectors configured to inject fuel into one or more cylinders of an engine;

a fuel rail fluidly coupled to the one or more direct fuel injectors;

a high pressure fuel pump fluidly coupled to the fuel rail; and a controller with computer readable instructions stored in non-transitory memory for:

while not direct injecting fuel into an engine and while the engine is in a stabilized idling condition, estimating a target fuel rail pressure based on a commanded target duty cycle of the high pressure fuel pump, and performing a closed loop and open loop control scheme until fuel rail pressure reaches the target fuel rail pressure.

19. The fuel system of claim 18, wherein estimating the target fuel rail pressure involves analyzing duty cycle and fuel rail pressure data from previous high pressure fuel pump operation.

20. The fuel system of claim 19, wherein duty cycle and fuel pressure data from previous high pressure fuel pump operation is stored in the controller.

* * * * *